US011679406B2

(12) United States Patent
Haarlander

(10) Patent No.: US 11,679,406 B2
(45) Date of Patent: Jun. 20, 2023

(54) MATERIAL APPLICATION AND CURING SYSTEM

(71) Applicant: Thomas Haarlander, Antioch, TN (US)

(72) Inventor: Thomas Haarlander, Antioch, TN (US)

( * ) Notice: Subject to any disclaimer, the term of this patent is extended or adjusted under 35 U.S.C. 154(b) by 0 days.

(21) Appl. No.: 17/559,353

(22) Filed: Dec. 22, 2021

(65) Prior Publication Data

US 2022/0193712 A1 Jun. 23, 2022

Related U.S. Application Data

(60) Provisional application No. 63/128,965, filed on Dec. 22, 2020.

(51) Int. Cl.

| | |
|---|---|
| ***B05B 16/20*** | (2018.01) |
| ***B05B 16/40*** | (2018.01) |
| ***B05B 13/02*** | (2006.01) |
| ***B05B 16/00*** | (2018.01) |

(52) U.S. Cl.

CPC ..... *B05B 16/20* (2018.02); *B05B 13/0228* (2013.01); *B05B 13/0264* (2013.01); *B05B 16/40* (2018.02); *B05B 16/90* (2018.02)

(58) Field of Classification Search

USPC ..... 118/326, 309, 634, 58, 64, 66, 500

See application file for complete search history.

(56) References Cited

U.S. PATENT DOCUMENTS

| | | | | | |
|---|---|---|---|---|---|
| 4,735,391 | A * | 4/1988 | Lawrence | A47B 96/068 | 248/205.5 |
| 5,107,789 | A * | 4/1992 | Salisbury | B05B 16/40 | 118/305 |
| 5,531,334 | A * | 7/1996 | Forby | B05B 13/02 | 204/297.09 |
| 5,820,673 | A * | 10/1998 | Sentilles | B29D 11/00865 | 118/643 |
| 2006/0233956 | A1* | 10/2006 | Hagman | B05B 13/0264 | 427/372.2 |
| 2017/0304860 | A1* | 10/2017 | Williams | B05B 16/20 | |

* cited by examiner

*Primary Examiner* — Yewebdar T Tadesse
(74) *Attorney, Agent, or Firm* — Bruce A. Lev

(57) ABSTRACT

A material application and curing system incorporating a spray booth connected alongside a curing chamber along with a pivoting cantilever therebetween adapted to swing materials between them, such that materials can be coated with substances in the spray booth and then quickly, easily, and efficiently transferred to the curing chamber.

12 Claims, 3 Drawing Sheets

MATERIAL APPLICATION AND CURING SYSTEM

CROSS-REFERENCE TO RELATED APPLICATION

The present application is related to and claims priority from provisional application Ser. No. 63/128,965, filed Dec. 22, 2020 which is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

The present invention relates generally to the field of material application and curing systems with related methods for the ability to apply powder coating paints as well as finishing treatment processes onto various materials to add innumerable varieties of substrates.

2. Description of the Related Art

Typically, users operate spray booth units and/or coating applications in different sections of a factory from their associated curing chambers. The previous method employed usually includes spraying a product in a paint booth, then moving it into a baking oven. The product usually needs to travel on racks down a tunnel or along a conveyor system on its way to the curing chamber. The main problem with this method includes paint or powder coat spilling off during the movement therebetween resulting in a deficient product and failing inspection.

There is also a significant cost when the spray booth and curing chamber are installed at separate locations within a facility. Separate installations require more electrical lines, circuit breakers, control boxes, and components, let alone more floor space.

Thus, a need exists for a material application and curing system to avoid the above-mentioned problems.

BRIEF SUMMARY OF THE INVENTION

In view of the foregoing disadvantages inherent in the known material application and curing systems and information readily available art, the present invention provides a novel material application and curing system. The general purpose of the present invention, which will be described subsequently in greater detail, is to provide a material application and curing system that incorporates a spray booth connected alongside a curing chamber along with a pivoting cantilever therebetween adapted to swing materials between them, such that materials can be coated with substances in the spray booth and then quickly, easily, and efficiently transferred to the curing chamber.

The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, material application and curing system, constructed and operative according to the teachings of the present invention.

The various embodiments of the present invention will hereinafter be described in conjunction with the appended drawings.

DETAILED DESCRIPTION

As discussed above, embodiments of the present invention relate to a material application and curing system that incorporates a spray booth connected alongside a curing chamber along with a pivoting cantilever therebetween adapted to swing materials between them, such that materials can be coated with substances in the spray booth and then quickly, easily, and efficiently transferred to the curing chamber.

Figure 1:
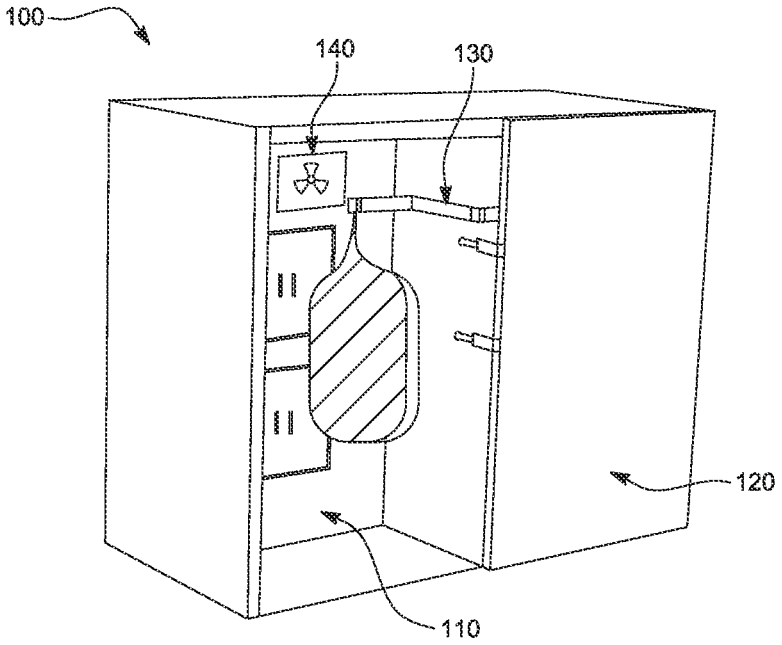
FIG. 1 shows a front left perspective view illustrating a material application and curing system according to an embodiment of the present invention.
Figure 2:
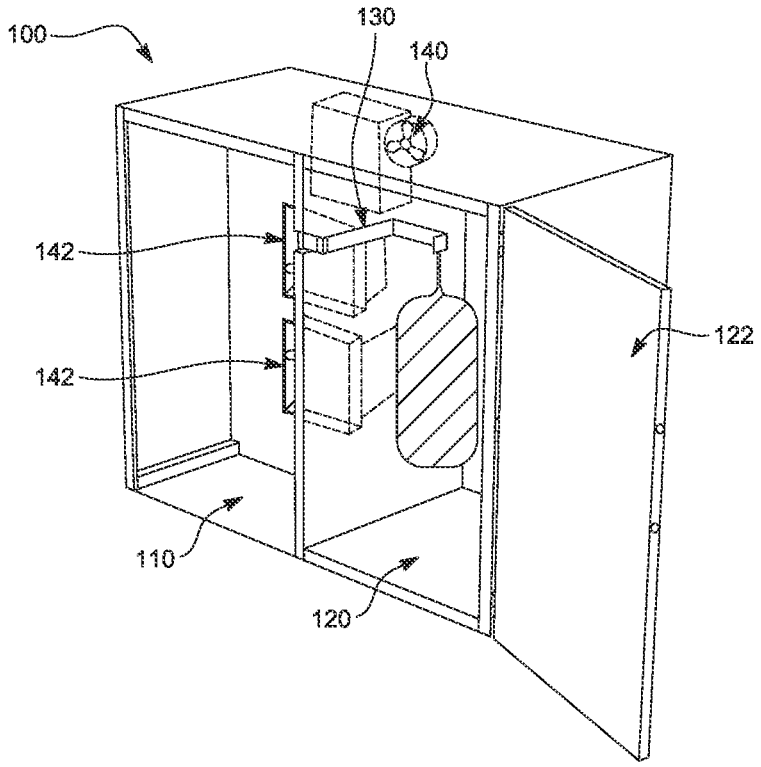
FIG. 2 shows a front right perspective view illustrating a material application and curing system according to an embodiment of the present invention.
Figure 3:
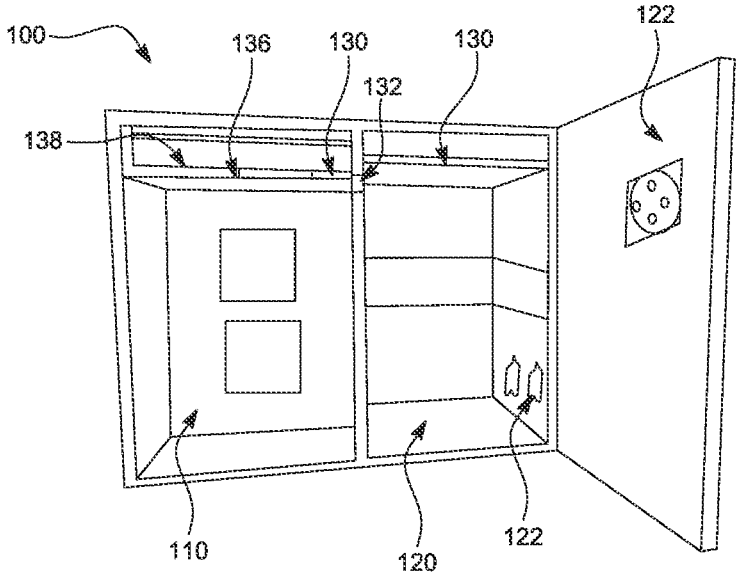
FIG. 3 shows a front view illustrating a material application and curing system according to an embodiment of the present invention.

Referring now to the drawings FIGS. 1-3, the material application and curing system 100 comprises a spray booth 110 connected alongside a curing chamber 120 along with a pivoting cantilever 130 therebetween adapted to swing materials between them, such that materials can be coated with substances in the spray booth and then quickly, easily, and efficiently transferred to the curing chamber.

Spray booth 110 includes four walls and a back wall defining an enclosure adapted to surround material placed therein. An air filter system is incorporated therein to exhaust fumes resulting from the chemicals used during spraying. The air filter system includes a fan member 140 and air filters 142.

Curing chamber 120 includes four walls, a back wall, and a pivoting door 122 defining an enclosure adapted to surround and enclose material placed therein for curing. Heating elements 124 are incorporated to heat material placed therein.

Adjacent walls between spray booth 110 and curing chamber 120 are connected together to form a center partition and both include a notch forming a pivoting cantilever notch 132 for pivotally attaching a proximal end of the pivoting cantilever 130. Pivoting cantilever notch 132 is shaped and positioned such that when pivoting cantilever 130 is pivoted into position within curing chamber 120 pivoting door 122 can closed properly.

Pivoting cantilever 130 is formed having an L-shape and is adapted to hold material in proper position within spray booth 110 for spraying and then be pivoted into curing chamber 120 to hold material in proper position therein for curing. The proximal end of the pivoting cantilever 130 includes a pin for pivotally attaching to pivoting cantilever notch 132. The distal end of pivoting cantilever 130 includes a holding member 136 adapted to hold material thereon during spraying and curing. Holding member 136 can be formed as a hook, or ring, or clamp. Other holding members can be also be used, including shelf 138.

FIG. 1 shows the pivoting cantilever 130 within spray booth 110. FIG. 2 shows the pivoting cantilever 130 within curing chamber 120 after being pivoted from spray booth 110.

In use, material is attached to the distal end of pivoting cantilever 130 and placed within the spray booth 110. While in spray booth 110 the air filter system is turned on and the material is sprayed with compounds as required. Once the spraying is completed, door 122 of curing chamber 120 is opened and pivoting cantilever 130 is pivoted, along with the material, into curing chamber 120, door 122 is closed, and when required heating elements turned on and curing commences. Once curing is done, door 122 is opened and pivoting cantilever 130 is pivoted outwardly for the material to be retrieved.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A material application and curing system comprising:

a spray booth including:

four walls; and a back wall;

wherein said four walls and said back wall form an enclosure adapted to surround material placed therein;

a curing chamber including:

four walls; and a back wall;

wherein said four walls and said back wall form an enclosure adapted to surround material placed therein;

wherein one of said four walls of said curing chamber is attached to one of said four walls of said spray booth and forms a center partition;

wherein said center partition includes a notch formed along a front edge thereof; and a pivoting cantilever;

wherein said pivoting cantilever is formed having an L-shape; and wherein said pivoting cantilever is pivotally connected at a proximal end thereof to said center partition within said notch, and is adapted to swing materials between said spray booth and said curing chamber;

a pivoting door;

wherein said pivoting door is pivotally connected via a side edge thereof to a front edge of one of said four walls of said curing chamber spaced from said wall attached to said wall of said spray booth, and is adapted to removably enclose said enclosure of said curing chamber;

wherein said material application and curing system is adapted such that materials can be hung from a distal end of said pivoting cantilever within said spray booth, coated with substances while within in said spray booth, pivoted via said pivoting cantilever into said curing chamber, and enclosed within said curing chamber for curing.

2. The material application and curing system of claim 1, wherein said distal end of said pivoting cantilever includes a holding member adapted to releasably hold materials thereon during spraying and curing.

3. The material application and curing system of claim 2, wherein said holding member is chosen from a list of holding members consisting of a hook, a ring, a clamp, and a shelf.

4. The material application and curing system of claim 1, wherein said spray booth further includes an air filter system attached thereto.

5. The material application and curing system of claim 4, wherein said air filter system of said spray booth includes at least one fan, and at least one air filter.

6. The material application and curing system of claim 1, wherein said curing chamber further includes at least one heating element attached thereto.

7. The material application and curing system of claim 1, wherein said spray booth further includes an air filter system attached thereto; and wherein said curing chamber further includes a heating element attached thereto.

8. The material application and curing system of claim 1, wherein said four walls and said back wall of said spray booth, said four walls and said back wall of said curing chamber, and said pivoting door are formed from a material chosen from a list of materials consisting of aluminum and stainless steel.

9. The material application and curing system of claim 1, wherein said pivoting cantilever is formed from a material chosen from a list of materials consisting of aluminum, stainless steel, and iron.

10. The material application and curing system of claim 1, wherein said spray booth further includes at least one shelf attached to at least one of said four walls thereof and within said enclosure thereof.

11. The material application and curing system of claim 1, wherein said curing chamber further includes at least one shelf attached to at least one of said four walls thereof and within said enclosure thereof.

12. The material application and curing system of claim 1, wherein said pivoting cantilever is pivotally connected to said center partition within said notch via a pivot pin.

* * * * *